US006443757B1

(12) United States Patent
Martinez

(10) Patent No.: US 6,443,757 B1
(45) Date of Patent: Sep. 3, 2002

(54) ELECTRICAL CHARGE SPLITTER

(76) Inventor: Leroy J. Martinez, 7679A Old Santa Fe Trail, Santa Fe, NM (US) 87505

( * ) Notice: Subject to any disclaimer, the term of this patent is extended or adjusted under 35 U.S.C. 154(b) by 0 days.

(21) Appl. No.: 09/473,215

(22) Filed: Dec. 27, 1999

(51) Int. Cl.[7] ..... H01R 4/24
(52) U.S. Cl. ..... 439/441
(58) Field of Search ..... 439/787, 439, 439/436, 441, 887; 377/60

(56) References Cited

U.S. PATENT DOCUMENTS

| | | | | |
|---|---|---|---|---|
| 2,255,553 A | | 9/1941 | Funk | 173/328 |
| 2,339,329 A | | 1/1944 | Funk | 173/328 |
| 2,514,336 A | | 7/1950 | Paige | 173/269 |
| 2,626,299 A | | 1/1953 | Richards | 173/328 |
| 3,263,202 A | | 7/1966 | Dean et al. | 339/150 |
| 3,351,885 A | | 11/1967 | Baldwin et al. | 339/74 |
| 3,381,261 A | | 4/1968 | Deakin | 339/248 |
| 3,937,548 A | | 2/1976 | Dittmann | 339/95 D |
| 4,056,299 A | * | 11/1977 | Paige | 439/441 |
| 4,199,211 A | | 4/1980 | Kidder | 339/98 |
| 4,329,555 A | | 5/1982 | Wied | 200/157 |
| 4,410,228 A | | 10/1983 | Stephenson | 339/95 D |
| 4,437,720 A | | 3/1984 | Harbauer | 339/95 D |
| 4,701,000 A | | 10/1987 | Suprono | 439/423 |
| 4,753,616 A | | 6/1988 | Molitor | 439/787 |
| 4,842,533 A | | 6/1989 | Beberman et al. | 439/213 |
| 4,842,553 A | | 6/1989 | Ingram | 439/583 |
| 4,854,898 A | * | 8/1989 | Turk | 439/723 |
| 5,011,440 A | | 4/1991 | Lee | 439/857 |
| 5,015,201 A | | 5/1991 | Brezee et al. | 439/441 |
| 5,149,279 A | * | 9/1992 | Kruse | 439/441 |
| 5,411,419 A | | 5/1995 | Ochi | 439/787 |
| 5,747,742 A | * | 5/1998 | Nelson | 439/730 |
| 6,173,622 B1 | | 1/2001 | Carnevale et al. | 74/335 |

* cited by examiner

*Primary Examiner*—Renne Luebke
*Assistant Examiner*—Briggitte R. Hammond
(74) *Attorney, Agent, or Firm*—Andrea L. Mays; Brian J. Pangrle

(57) ABSTRACT

An electrical connector capable of connecting, diverting and/or splitting electrical charges between a plurality of conductors.

22 Claims, 8 Drawing Sheets

ELECTRICAL CHARGE SPLITTER

BACKGROUND OF THE INVENTION

1. Field of the Invention (Technical Field)

This invention relates to connectors for electrical circuits.

2. Background Art

U.S. Pat. No. 3,937,548, entitled "Device for splicing wire," to Dittmann, issued Feb. 26, 1975 discloses a single elongated housing of insulating material and a one piece contact strip for splicing two wires together.

SUMMARY OF THE INVENTION (DISCLOSURE OF THE INVENTION)

The present invention comprises an electrical charge splitter comprising a housing comprising at least two conductor openings, a conductor base housed within the housing, and at least two conductor insertion openings positioned on the base. The at least two insertion openings are accessible through the at least two conductor openings of the housing wherein each insertion opening comprises brackets for securing a conductor and providing electrical continuity with the base. In a preferred embodiment of the present invention, the charge splitter comprises a conductor divider positioned within the housing wherein the divider prevents physical contact between at least two conductors. In another preferred embodiment of the present invention, the charge splitter comprises at least one adjacent housing comprising at least one conductor opening and an insulating material. The insulating material is containable in, for example, a film. Suitable films include but are not limited to, for example, latex, while insulating material comprises, for example, but not limited to, silicone. The charge splitter of the present invention further comprises a wrap for surrounding the housing. The wrap comprises, for example, heat shrink material in, for example, sheet or tube form. Furthermore, wrap that is specially shaped to conform to the shape of the housing and associated connectors is also within the scope of the present invention.

In yet another preferred embodiment of the present invention, the electrical charge splitter comprises a housing comprising at least four conductor openings; at least one conductor base housed within the housing; at least four conductor insertion openings positioned on the at least one base; the at least four insertion openings accessible through the at least four conductor openings of the housing wherein each insertion opening comprises brackets for securing a conductor and providing electrical continuity with the at least one base; and a switch for controlling electrical continuity of conductors inserted into the housing. In a preferred embodiment of the present invention, the switch comprises at least two conductive insertion tips for insertion into the at least two insertion openings and a selector for selectably controlling electrical continuity of the at least two insertion tips. This preferred embodiment also optionally comprises a conductor divider positioned within the housing wherein the divider prevents physical contact between at least two conductors. This preferred embodiment also comprises at least one adjacent housing comprising at least one conductor opening and an insulating material and/or a wrap.

An inventive connector that is within the scope of the present invention also helps secure conductors to the charge splitter. The connector for securing conductors to electrical charge splitters comprises a conductive plate comprising at least three sides wherein the sides comprise inner and outer surfaces and the inner surfaces comprise surface indicia for increasing the coefficient of friction of the inner surface.

An inventive disconnector for detaching conductors from an electrical charge splitter is also within the scope of the present invention. A disconnector of the present invention comprises a platform comprising a base and at least two perpendicular walls attached to the base, each of the walls comprising at least one aperture. The disconnector further comprises a rod positionable through the apertures and a penetrator comprising at least one movable conductor channel for positioning the penetrator with respect to the electrical charge splitter. In a preferred embodiment, the disconnector comprises a strap for securing the electrical charge splitter to the platform. In yet another preferred embodiment, the disconnector rod comprises a stop comprising a cross-sectional area greater than a cross-sectional area of at least one of the apertures. In a preferred embodiment, the rod comprises threaded grooves and the penetrator comprises a ring attached to the conductor channel and an integrated rotating knob attached to the ring comprising threaded grooves wherein rotation of the knob engages the knob threaded groves with the rod threaded grooves and positions the penetrator with respect to the electrical charge splitter. As the penetrator approaches the charge splitter, the conductor channel moves along a conductor and enters the housing and the insertion opening. Once in the insertion opening, the conductor channel widens any brackets surrounding the conductor so as to relieve force on the conductor. Once the force is relieved, the conductor is then disconnected from the charge splitter.

A primary object of the present invention is to connect conductors.

A primary advantage of the present invention is a capability to make a plurality of connections between a plurality of conductors.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

In a preferred embodiment of the present invention, the inventive apparatus has the capability to extend and/or split multiple types of electrical charges transmitted via cables comprising at least one wire. Furthermore, by adding additional housings and connector bases a plurality of wires are accommodated. The inventive apparatus is for use with existing or new conductors/electrical wires. The inventive apparatus accommodates solid and/or stranded conductors. Use of stranded conductors is facilitated through use of a STRAN-NECTOR connector of the present invention. The present invention is for use with alternating current (AC) and/or direct current (DC). The present invention is suitable for use indoor and/or outdoor. In preferred embodiments of the present invention, the invention apparatus further comprises attached and detached switches. Conductors are releasable from the inventive apparatus through use of a Y-ER-DETACHER tool of the present invention. The invention apparatus also comprises protective options for safety reasons and moisture proofing achieved through, but not limited to, for example, wrapping, sealing or encasing the inventive apparatus. In a preferred embodiment, the present invention comprises silicon filled ends. In another preferred embodiment, the invention comprises heat shrink wrap and/or heat shrink tubing.

Figure 1:
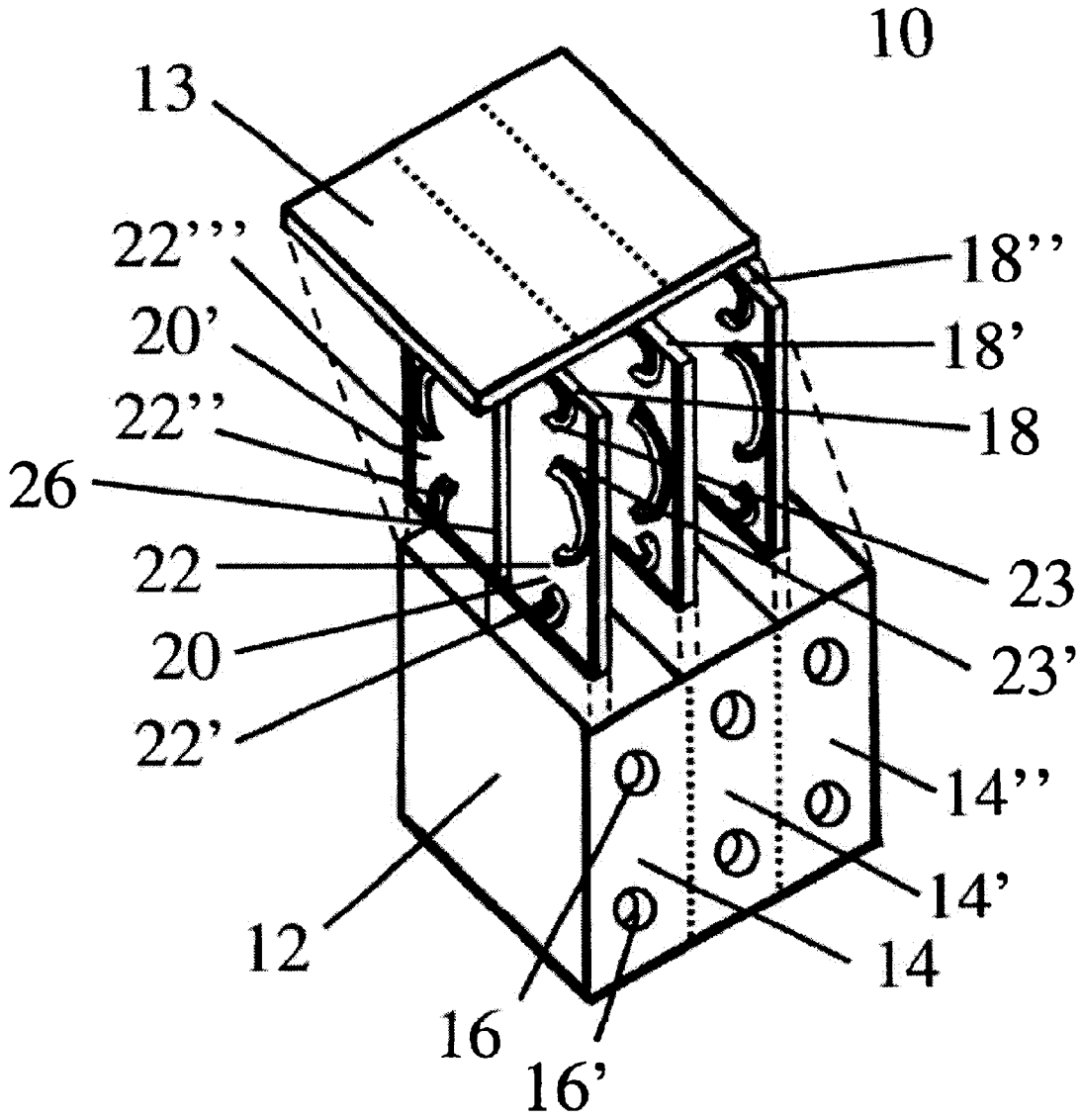
FIG. 1 is a perspective view of a preferred embodiment of the present invention comprising three connectors in a housing.

FIG. 1 is an illustration of the preferred embodiment of the present invention 10. This embodiment comprises a housing 12 and at least one conductor base 18, 18', 18''' that are housed within the housing 12. In this particular embodiment, the housing 12 comprises a cover 13 and at least one non-conductive compartment 14, 14', 14''' and at least two conductor openings 16, 16'. In this particular embodiment, the conductive base 18 comprises at least two conductor insertion openings 20, 20', formed by two angled brackets 22, 22', 22'', 22'''; a conductor divider 26 positioned between the conductor insertion openings; and a conductor base 18. In a preferred embodiment, each conductor insertion opening and conductor divider 26 is formed from and part of the conductor base 18. End points 23 of each angled bracket 22 prevent the conductor from being easily removed from insertion opening 20 after being inserted, due to end points 23 being angled inward toward the central portion of base 18 and in the direction of the conductor insertion.

Figure 2:
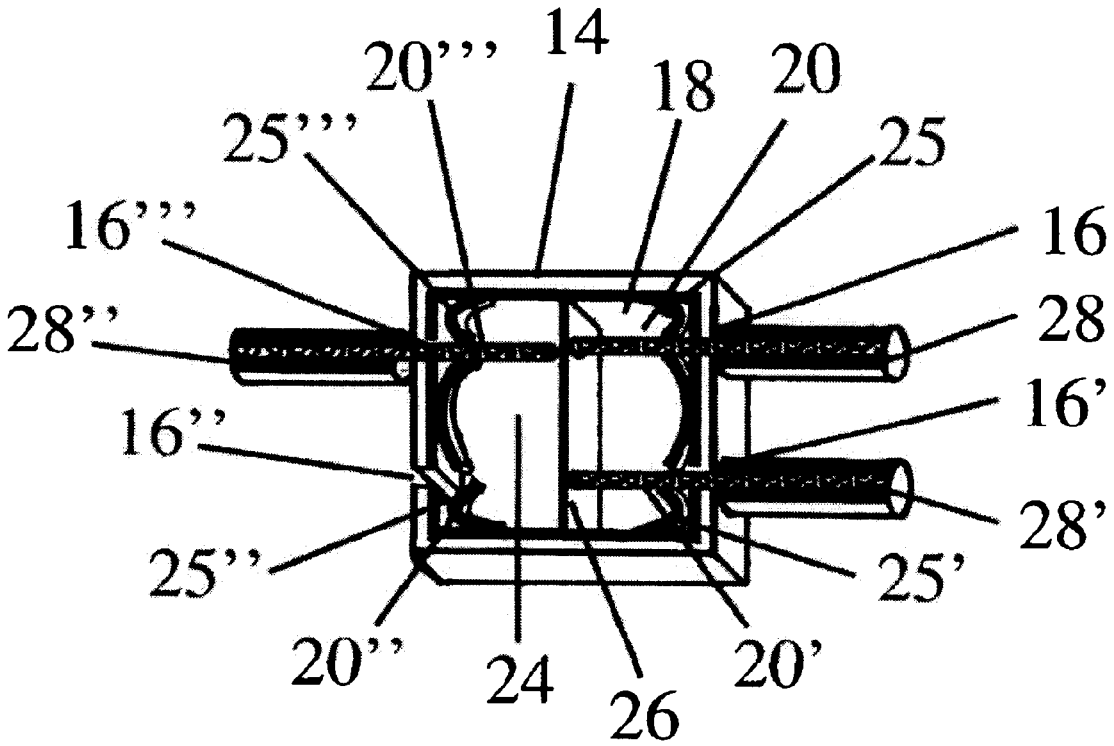
FIG. 2 is a cross-sectional view of a preferred embodiment of the present invention comprising a diversion and splitting of an electrical charge into two electrical charges.

FIG. 2 shows a preferred embodiment of the present invention. This embodiment comprises a non-conductive compartment 14 with conductor openings 16, 16', 16'', 16''', and a conductor base 18 that is housed within the non-conductive compartment 14. In this particular embodiment, the conductor base 18 comprises four conductor insertion openings 20, 20', 20'', 20''', four pairs of brackets 23, 23', 23'', 23''' and a conductor divider 26 all of which are formed from and part of the conductor base 18. In this particular embodiment, three conductors 28, 28', 28'' are biased by brackets 23, 23', 23'''.

Figure 3:
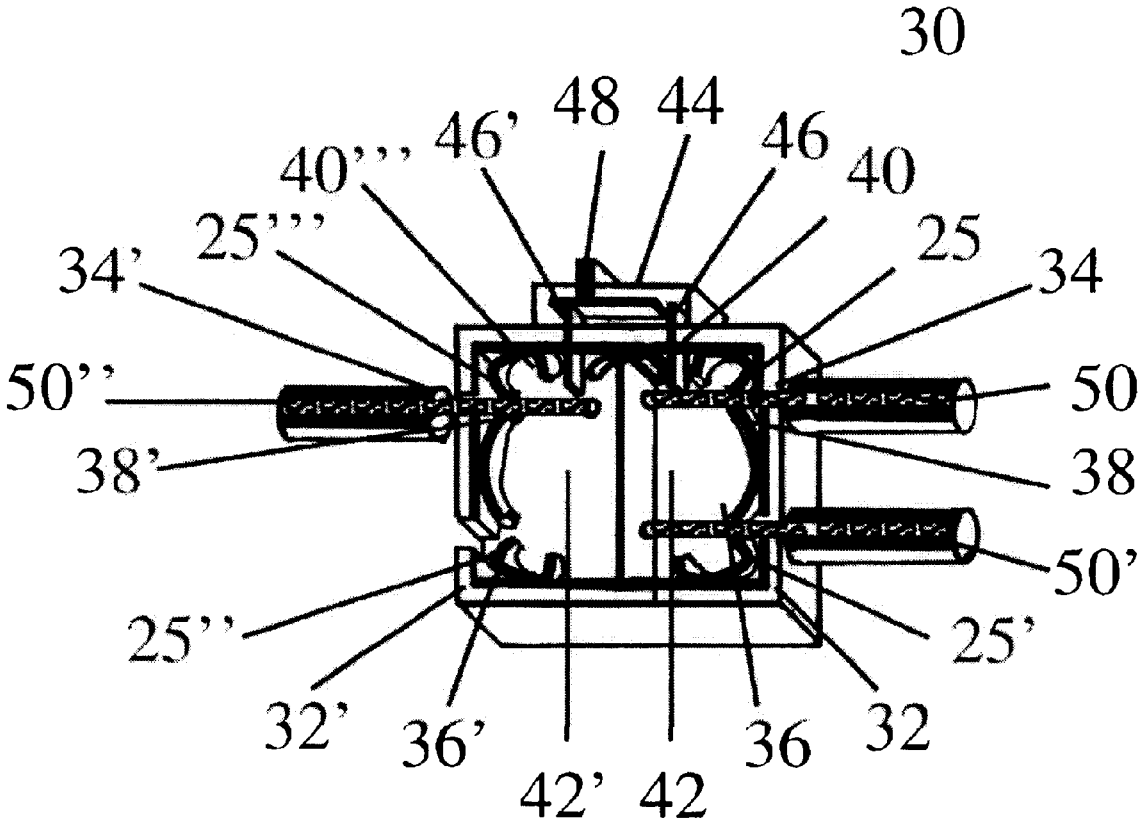
FIG. 3 is a cross-sectional view of a preferred embodiment of the present invention comprising a selector switch.

FIG. 3 shows a preferred embodiment of the present invention 30. This embodiment comprises two housing compartments 32, 32' housing two connectors 36, 36' and an attachable switch 44. In this particular embodiment, the housing compartments 32, 32' are non-conductive and prevent electrical continuity. This embodiment also comprises at least two conductor openings 34, 34' located on at least two housing compartments. In this particular embodiment, each connector 36, 36' comprises at least one conductor insertion opening 38, 38' formed by at least one pair of brackets 23, 23', 23'', 23''' at least one switch connector opening comprising at least one pairs of brackets 40, 40' and a conductor base 42. Each conductor insertion opening 23, 23' is formed from and part of the conductor base 42. In this particular embodiment, the attachable switch 44 comprises at least two conductive insertion tips 46, 46' and a selector 48 for selecting at least one path for electrical continuity. The selector 48 comprises a conductive material for allowing electrical continuity between the at least two conductive insertion tips 46, 46'. Each insertion tip 46, 46' is secured by at least one pair of brackets 40, 40', and in electrical contact with at least one conductor base 42, 42'. It is understood that an insertion tip is a conductor and suitable for insertion into any conductor insertion opening. In this particular embodiment, three conductors 50, 50', 50'' are secured by brackets 23, 23', 23''' and in contact with conductor bases 42, 42'. The attachable switch controls and maintains electrical contact between conductor bases 42, 42' thereby allowing flow of current between conductors 50, 50', 50''.

Figure 4:
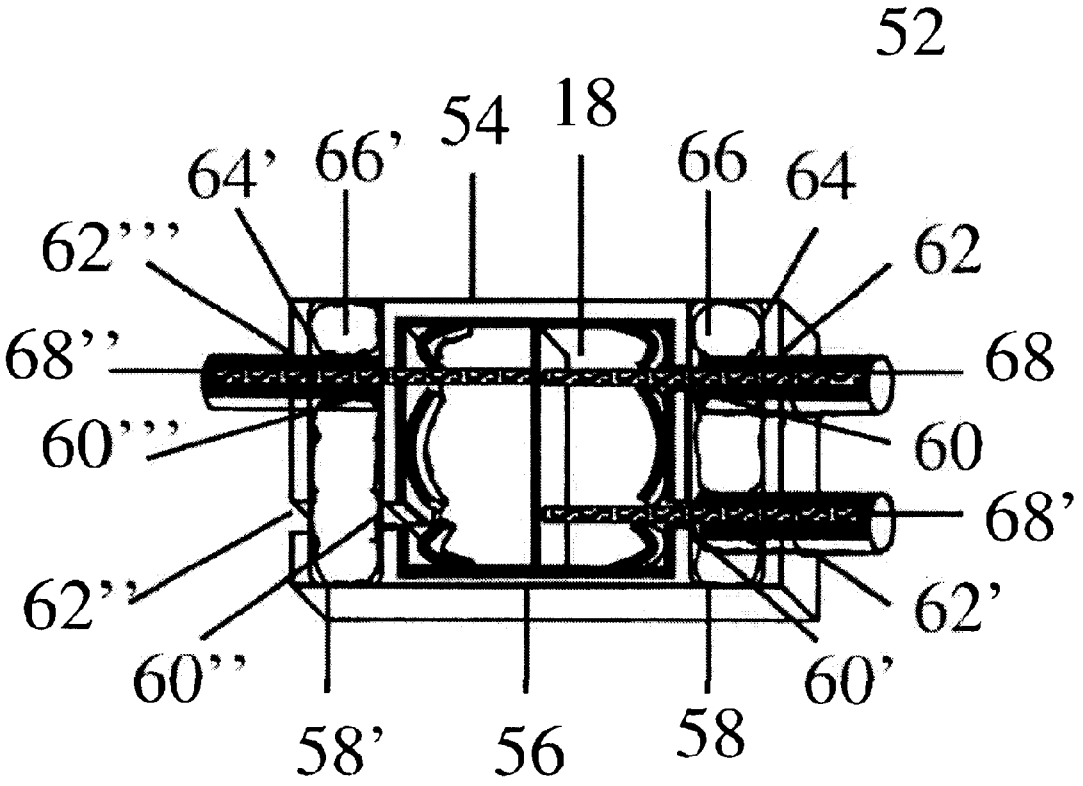
FIG. 4 is a cross-sectional view of a preferred embodiment of the present invention comprising silicon filled compartments.

FIG. 4 shows a preferred embodiment of the present invention 52. This embodiment comprises a housing 54 that further comprises a center compartment 56 and adjacent compartments 58, 58'. The center compartment 56 further comprises a connector 18 while adjacent compartments 58, 58' further comprise an insulating material 66, 66', such as, but not limited to, silicone. The rheological properties of insulating material are selectable to also help secure conductors. In this particular embodiment, the center compartment 56 comprises four conductor openings 60, 60', 60'', 60''' while adjacent compartments 58, 58' comprise four matching conductor openings 62, 62', 62'', 62'''. In this particular embodiment, silicone 66, 66' is contained within a film comprising, for example, but not limited to, latex 64, 64'. The film 64, 64' acts as a barrier and helps maintain desirable physical properties of the insulating material. For example, a film can help to keep silicone soft and pliable. The film is also selected to be puncturable by a conductor. In another embodiment, the physical properties of insulating material change upon puncturing of the film to further secure conductors. In this particular embodiment, three conductors 68, 68', 68'' form puncture holes in the films 64, 64' containing silicone. The conductors 68, 68', 68'' are secured by brackets of the conductor base 18.

Figure 5:
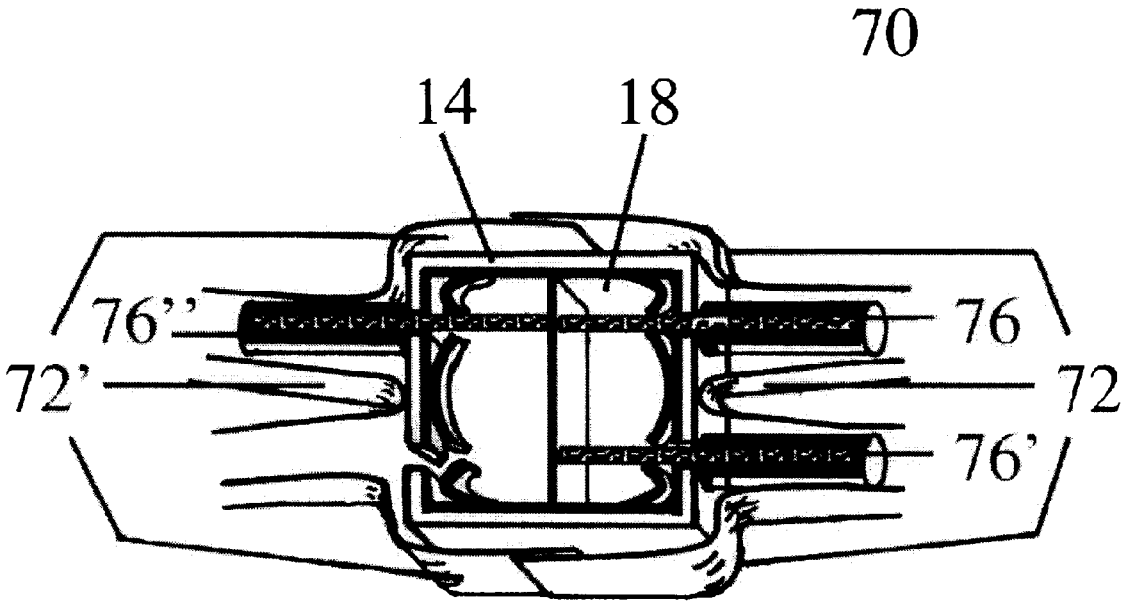
FIG. 5 is a cross-sectional view of a preferred embodiment of the present invention comprising heat shrink tubing.

FIG. 5 shows a preferred embodiment of the present invention 70. This embodiment comprises a non-conductive housing 14 and a four-conductor connector 18 housed within the non-conductive housing 14. In this particular embodiment, three conductors 76, 76', and 76'' are secured and held in electrical contact with a conductor base 18. In this particular embodiment, at least one wrap or tube 72, 72' surrounds the connections. In FIG. 5, one wrap 72' is slightly larger for overlapping the other wrap 72. In a preferred embodiment, the wraps 72, 72' shrink when heated to protect the connections in relation to the field of use of the apparatus.

Figure 6:
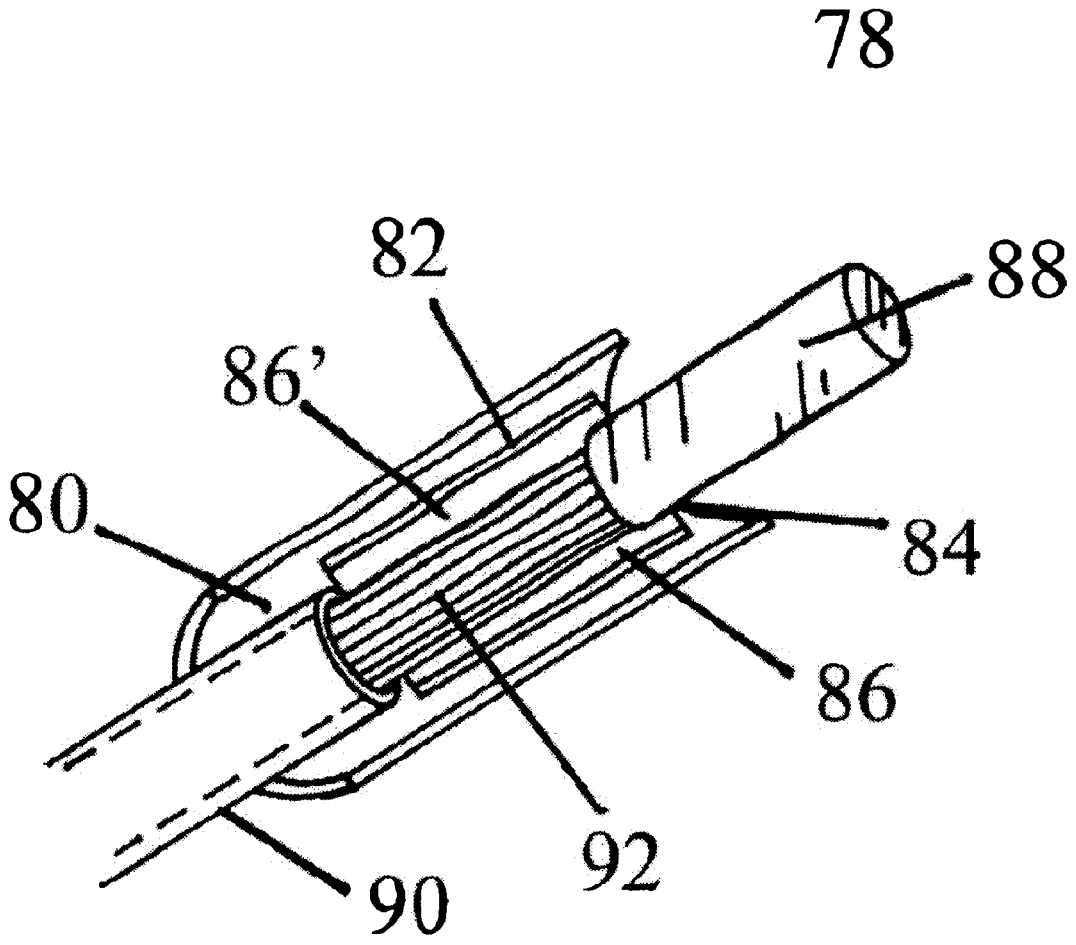
FIG. 6 is a perspective view of a "Stran-Nector" connector of the present invention, which allows attachment of stranded wire.

FIG. 6 shows a preferred embodiment of the present invention 78. This embodiment comprises an insulating barrier cover 80 and the "Stran-Nector" connector 82. In this particular embodiment, the "Stran-Nector" connector 82 comprises three flat sides 84, 86, 86'. The flat sides further comprise inner and outer surfaces. The inner surfaces comprise surface indicia that increase the coefficient of friction and frictional forces when the inner surface is placed in contact with another surface. For example, in this particular embodiment, a conductor 90 comprising an outer conductor 92 and center core 88 is used. The outer conductor 92 comprises an outer surface that contacts the inner surfaces of the flat sides 84, 86, 86'. Again, surface indicia of the inner surfaces of the flat sides 84, 86, 86' increases friction between the outer surface of the outer conductor 92 upon application of force. The center core 88 is either supplied with a conductor 90 or such a core is inserted into the conductor.

Figure 7:
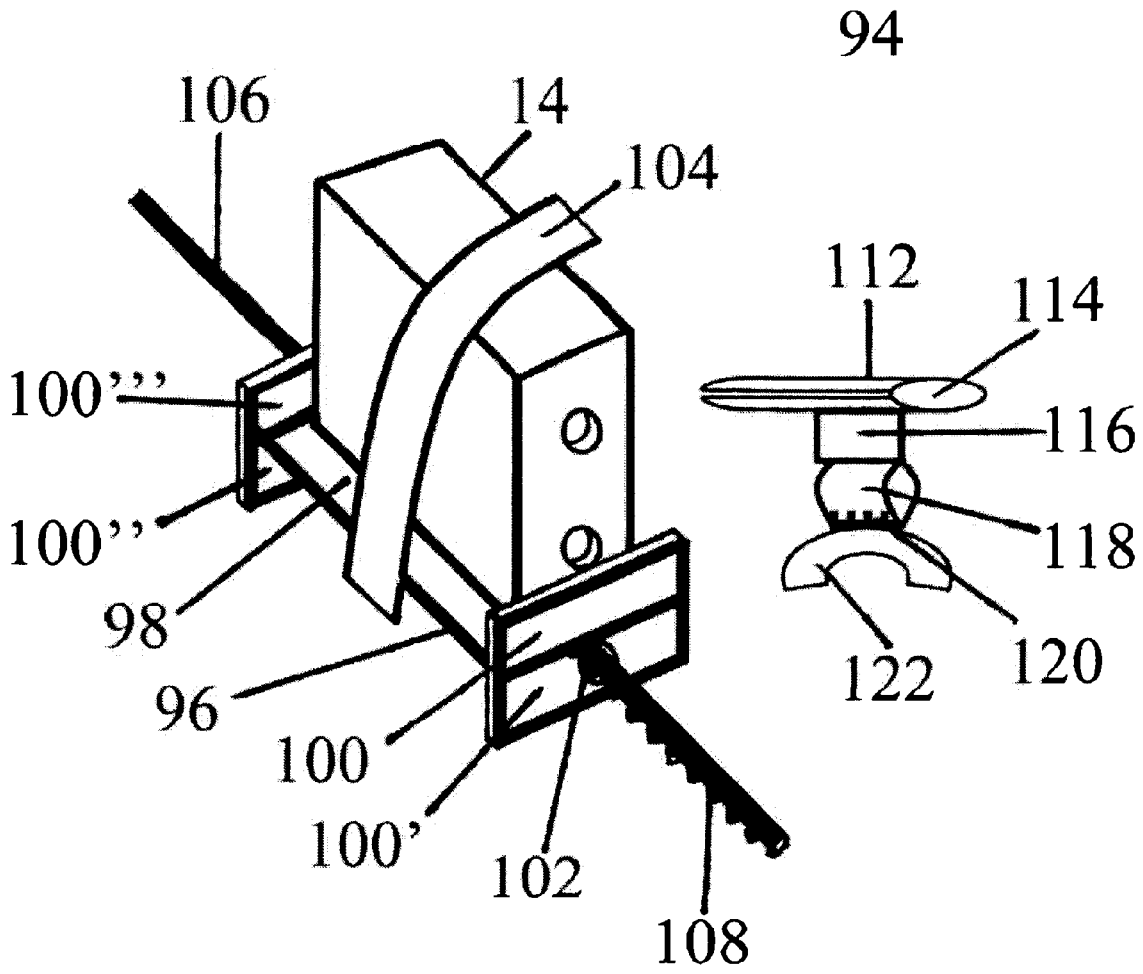
FIG. 7 is a perspective view of a "Y-Er-Detacher" tool of the present invention, which allows detachment of connected wires/conductors.
Figure 8:
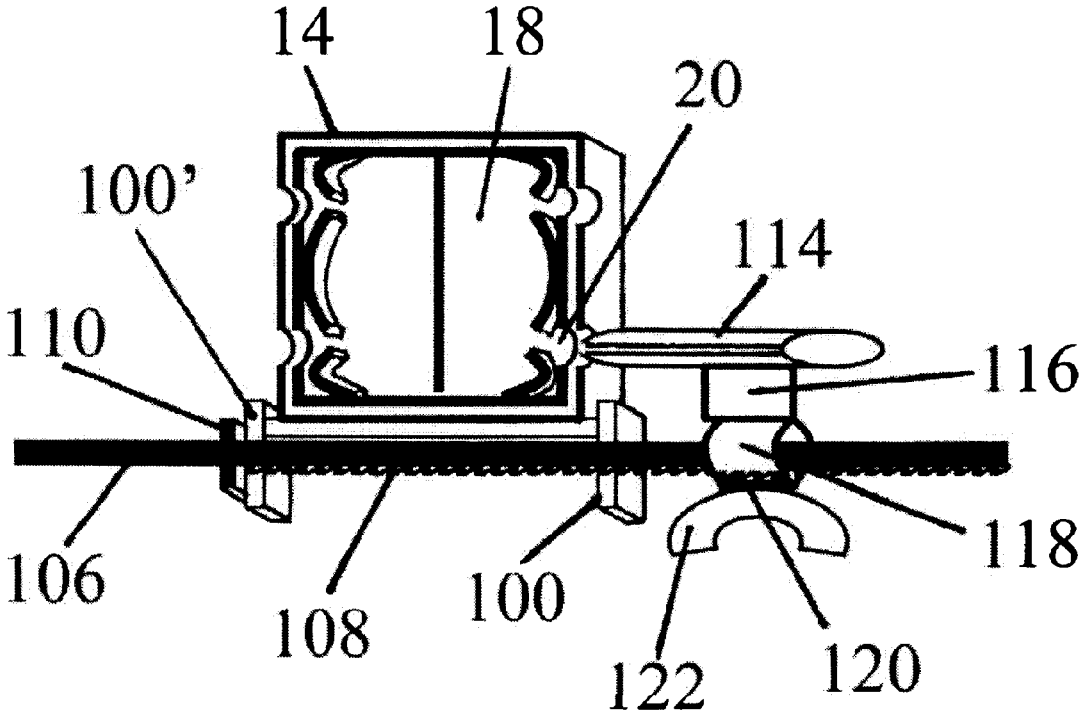
FIG. 8 is a cross-sectional view of a "Y-Er-Detacher."

FIGS. 7 and 8 show an additional preferred embodiment of the present invention 94 that comprises a disconnector for disconnecting conductors from the electrical charge splitter. This embodiment comprises a platform 96, a strap 104 to hold down housing compartments 14 of the present invention to the platform 96, a square rod 106, and penatrator 112. In this particular embodiment, the platform 96 comprises a bottom base 98, perpendicular upper and lower ends 100, 100', 100", 100'" and a rod opening 102 located on the bottom portion of each perpendicular end. In this particular embodiment, the square rod 106 comprises an elongated rod with downward curved threaded grooves 108, and a rod stop 110. In this particular embodiment, the moving penatrator 112 comprises at least one open wire channel 114, a spacer 116 for height alignment, a box ring 118, and an integrated rotating knob 122 with upward curved threaded grooves 120. When the moving penatrator 112 is inserted into the conductor insertion openings 20 of the present invention the connected wires are detached in relation to the field of use of the apparatus.

Industrial Applicability

The invention is further illustrated by the following non-limiting examples.

Example 1

Connectors were made out of a single piece of copper without a divider. The connectors accommodate two or four conductor openings. The conductor openings are for use with 14-gauge solid house wire. Housings for the two and four conductor connectors were constructed out of cut flat pieces of plastic that were glued together. The outer edges of the housings were sanded. Careful measurements were performed before drilling the conductor openings on the plastic housing. A three-compartment housing that housed three four-wire connectors was constructed. Three small pieces of 14/2-house wire were utilized. One end of each piece of 14/2 house wire was connected to the inventive apparatus, while an electrical plug, a light socket, and an electrical outlet were connected to the other ends.

The upper number of conductor openings for a connector is unlimited, while the lower number must be a minimum of two. The conductor openings are locatable along any part of the connector that preferably provide for construction of securing brackets. For all practical purposes, size of the conductor openings and the strength of brackets are constructed for ranges of conductors. Although copper was used, any type of conductive material is suitable, including, but not limited to, brass, gold, silver, iron, composite materials, etc. The type of material is also selectable to meet industry standards.

A STRAN-NECTOR connector was constructed from a pin connector from Radio Shack. The STRAN-NECTOR connector was tested for continuity and connected to an electrical charge splitter.

The switch connector and corresponding housing have the capability to attach the specially designed switch or another wire for a detachable switch. The detachable switch is either another switch connector or another type of commercial switch. Wire/Attached Switch connections are made on the bottom, top or sides of the present invention. The type of switch, a single pole with single throw or a single pole with multiple throws is utilized depending on use. For example, if only the positive charge in a 14/2 type wire needs to be controlled, then a single pole single throw switch and a switch connector within one housing compartment would be utilized. The other two charges (negative and ground) continue to flow by using the typical connectors housed within the other two housing compartments.

The electrical charge splitters of the present invention are also connectable in that conductor bases are placed side by side as shown in FIG. 1. Likewise, a switch can create at least one connection between side-by-side conductor bases. In such embodiments, a switch can straddle more than one housing and create connections between housings or alternatively, a housing can house more than one conductor base wherein a switch can straddle more than one base in a single housing. The wrap and other features of the present invention are applicable to the side-by-side configurations of conductor bases.

All concepts associated with the present invention apply to the silicone connector, and the wrap connector.

The "Y-Er-Detacher" has the ability to detach any number of wires from the present invention different variations of the penetrator. With an extended variation of the canal portion of the penetrator wires connected to the silicon connector can also be detached.

The preceding examples can be repeated with similar success by substituting the generically or specifically described material of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An electrical charge splitter comprising:

a housing comprising at least two conductor openings;

a conductor base within said housing for receiving at least two conductors inserted into corresponding ones of said at least two conductor openings, said base defining a plane having at least two edges, at least one of said edges for receiving at least one conductor in the same plane as defined by said base; and at least two conductor insertion openings corresponding to said conductor openings and positioned near said base edges, said insertion openings accessible through said conductor openings on said housing, wherein each insertion opening comprises a pair of opposing angled brackets forming opposing end points for engaging and securing a conductor, said brackets providing electrical continuity with said base, said brackets oriented to be forced open in the plane defined by said base upon receiving the conductor, and wherein engagement of said opposing end points with the conductor resists removal of the conductor from said insertion opening to secure the conductor.

2. The charge splitter of claim 1 further comprising a conductor divider, said divider defining a plane oriented transverse to and upon said base, said divider preventing an end of a conductor having two ends from extending beyond said divider.

3. The charge splitter of claim 1 further comprising at least one adjacent housing comprising at least one conductor opening and an insulating material.

4. The charge splitter of claim 3 wherein said at least one adjacent housing comprises a film for containing said insulating material.

5. The charge splitter of claim 4 where said film comprises latex and said insulating material comprises silicone.

6. The charge splitter of claim 1 further comprising a wrap for surrounding said housing after at least one conductor has been inserted into an insertion opening.

7. The charge splitter of claim 6 wherein said wrap shrinks upon exposure to heat.

8. The electrical charge splitter of claim 1, further comprising a connector for securing conductors to said electrical charge splitter comprising a conductive plate comprising at least three sides wherein said sides comprise inner and outer surfaces and said inner surfaces comprise surface indicia for increasing the coefficient of friction of said inner surface.

9. The electrical charge splitter of claim 1, further comprising a disconnector for detaching conductors from said electrical charge splitter, said disconnector comprising:

a platform comprising a base and at least two perpendicular walls attached to said base, each said wall comprising at least one aperture;

a rod positionable through said apertures; and a penetrator comprising at least one movable conductor channel for positioning said penetrator with respect to said electrical charge splitter.

10. The charge splitter of claim 9, said disconnector comprising a strap for securing said electrical charge splitter to said platform.

11. The charge splitter of claim 9, said disconnector comprising a stop wherein said stop comprises a cross-sectional area greater than a cross-sectional area of said at least one aperture.

12. The charge splitter of claim 9, wherein said rod comprises threaded grooves.

13. The charge splitter of claim 12 wherein said penetrator comprises a ring attached to said conductor channel and an integrated rotating knob attached to said ring comprising threaded grooves wherein rotation of said knob engages said knob threaded groves with said rod threaded grooves and positions said penetrator with respect to the electrical charge splitter.

14. The charge splitter of claim 1 wherein said housing comprises at least one additional conductor base, each of said conductor bases electrically isolated from one another, and a switch for controlling electrical continuity of conductors inserted into said housing from one conductor base to another.

15. The charge splitter of claim 14 wherein said switch comprises at least two conductive insertion tips for insertion into said at least two insertion openings and a selector for selectably controlling electrical continuity of said at least two insertion tips.

16. The charge splitter of claim 14 further comprising a conductor divider, said divider defining a plane oriented transverse to and upon said base, said divider preventing an end of a conductor having two ends from extending beyond said divider.

17. The charge splitter of claim 14 further comprising a wrap for surrounding said housing.

18. The charge splitter of claim 14 wherein said wrap shrinks upon exposure to heat.

19. The charge splitter of claim 14 further comprising at least one adjacent housing comprising at least one conductor opening and an insulating material.

20. The charge splitter of claim 19 wherein said at least one adjacent housing comprises a film for containing said insulating material.

21. The charge splitter of claim 20 where said film comprises latex and said insulating material comprises silicone.

22. An electrical charge splitter comprising:

a housing comprising a plurality of conductor openings;

a conductor base within said housing for receiving a plurality of conductors inserted into corresponding of said plurality of conductor openings, said base defining a plane having at least two edges, at least one of said edges for receiving at least one conductor in the same plane as defined by said base; and a plurality of conductor insertion openings corresponding to said conductor openings and positioned near said base edges, said insertion openings accessible through said conductor openings on said housing, wherein each insertion opening comprises a pair of opposing angled brackets forming opposing end points for engaging and securing a conductor, said brackets providing electrical continuity with said base, said brackets oriented to be forced open in the plane defined by said base upon receiving the conductor, and wherein engagement of said opposing end points with the conductor resists removal of the conductor from said insertion opening to secure the conductor.

* * * * *

UNITED STATES PATENT AND TRADEMARK OFFICE

CERTIFICATE OF CORRECTION

PATENT NO. : 6,443,757 B1
DATED : September 3, 2002
INVENTOR(S) : Leroy J. Martinez It is certified that error appears in the above-identified patent and that said Letters Patent is hereby corrected as shown below:

Drawings,
Change illustrative Fig. to FIG. 1, illustrative figure, as shown on the attached title page.

Signed and Sealed this

Twenty-fourth Day of June, 2003

JAMES E. ROGAN
*Director of the United States Patent and Trademark Office*

(12) United States Patent
Martinez

(10) Patent No.: US 6,443,757 B1
(45) Date of Patent: Sep. 3, 2002

(54) ELECTRICAL CHARGE SPLITTER

(76) Inventor: Leroy J. Martinez, 7679A Old Santa Fe Trail, Santa Fe, NM (US) 87505

( * ) Notice: Subject to any disclaimer, the term of this patent is extended or adjusted under 35 U.S.C. 154(b) by 0 days.

(21) Appl. No.: 09/473,215

(22) Filed: Dec. 27, 1999

(51) Int. Cl.[7] ..... H01R 4/24
(52) U.S. Cl. ..... 439/441
(58) Field of Search ..... 439/787, 439, 439/436, 441, 887; 377/60

(56) References Cited

U.S. PATENT DOCUMENTS

| | | | | | |
|---|---|---|---|---|---|
| 2,255,553 | A | | 9/1941 | Funk | 173/328 |
| 2,339,329 | A | | 1/1944 | Funk | 173/328 |
| 2,514,336 | A | | 7/1950 | Paige | 173/269 |
| 2,626,299 | A | | 1/1953 | Richards | 173/328 |
| 3,263,202 | A | | 7/1966 | Dean et al. | 339/150 |
| 3,351,885 | A | | 11/1967 | Baldwin et al. | 339/74 |
| 3,381,261 | A | | 4/1968 | Deakin | 339/248 |
| 3,937,548 | A | | 2/1976 | Dittmann | 339/95 D |
| 4,056,299 | A | * | 11/1977 | Paige | 439/441 |
| 4,199,211 | A | | 4/1980 | Kidder | 339/98 |
| 4,329,555 | A | | 5/1982 | Wied | 200/157 |
| 4,410,228 | A | | 10/1983 | Stephenson | 339/95 D |
| 4,437,720 | A | | 3/1984 | Harbauer | 339/95 D |
| 4,701,000 | A | | 10/1987 | Suprono | 439/423 |
| 4,753,616 | A | | 6/1988 | Molitor | 439/787 |
| 4,842,533 | A | | 6/1989 | Beberman et al. | 439/213 |
| 4,842,553 | A | | 6/1989 | Ingram | 439/583 |
| 4,854,898 | A | * | 8/1989 | Turk | 439/723 |
| 5,011,440 | A | | 4/1991 | Lee | 439/857 |
| 5,015,201 | A | | 5/1991 | Brezee et al. | 439/441 |
| 5,149,279 | A | * | 9/1992 | Kruse | 439/441 |
| 5,411,419 | A | | 5/1995 | Ochi | 439/787 |
| 5,747,742 | A | * | 5/1998 | Nelson | 439/730 |
| 6,173,622 | B1 | | 1/2001 | Carnevale et al. | 74/335 |

* cited by examiner

*Primary Examiner*—Renne Luebke
*Assistant Examiner*—Briggitte R. Hammond
(74) *Attorney, Agent, or Firm*—Andrea L. Mays; Brian J. Pangrle

(57) ABSTRACT

An electrical connector capable of connecting, diverting and/or splitting electrical charges between a plurality of conductors.

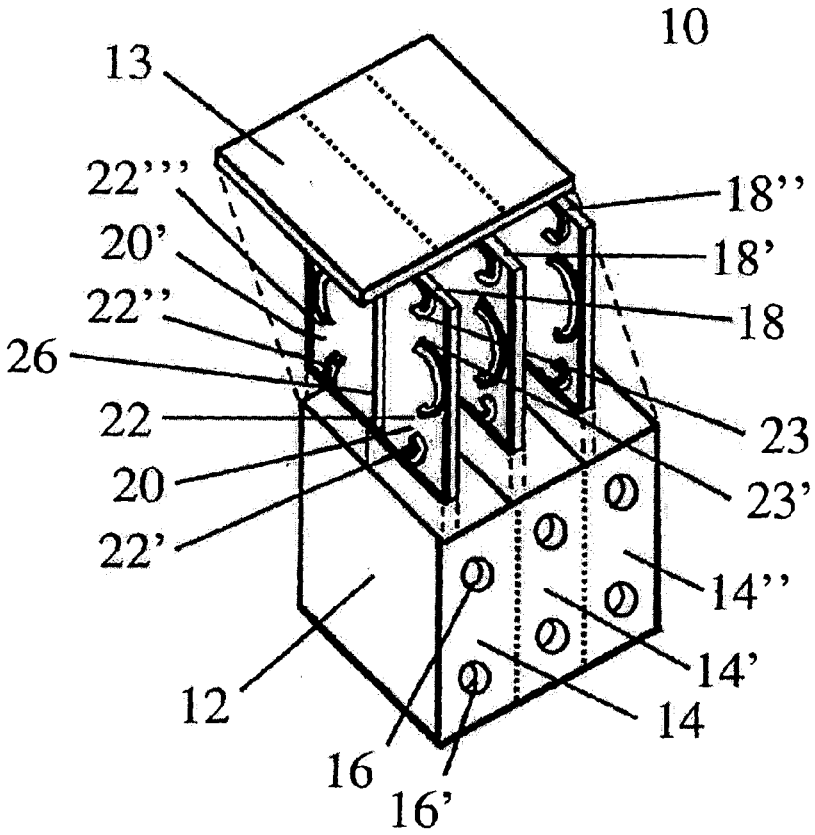

22 Claims, 8 Drawing Sheets